US005243774A

United States Patent [19]

Mattiuzzo

[11] Patent Number: 5,243,774

[45] Date of Patent: Sep. 14, 1993

[54] SKI BOOT WITH SHELL AND COLLAR

[75] Inventor: Mario Mattiuzzo, Treviso, Italy

[73] Assignee: Skis Rossignol S.A., France

[21] Appl. No.: 835,859

[22] Filed: Feb. 18, 1992

[30] Foreign Application Priority Data

Feb. 26, 1991 [FR] France ..... 91 02521

[51] Int. Cl.[5] ..... A43B 5/04

[52] U.S. Cl. ..... 36/117; 36/120; 36/121

[58] Field of Search ..... 36/117, 118, 119, 120, 36/121

[56] References Cited

U.S. PATENT DOCUMENTS

| | | | |
|---|---|---|---|
| 3,975,838 | 8/1976 | Martin | 36/121 |
| 4,499,676 | 2/1985 | Chalmers, II | 36/117 |
| 4,510,703 | 4/1985 | Eiteljorg | 36/117 |
| 4,577,421 | 3/1986 | Sartor | 36/117 |
| 5,003,710 | 4/1991 | Pozzobon | 36/120 |
| 5,101,582 | 4/1992 | Pozzobon | 36/117 |
| 5,107,609 | 4/1992 | Sartor | 36/120 |

FOREIGN PATENT DOCUMENTS

| | | | |
|---|---|---|---|
| 0128133 | 12/1984 | European Pat. Off. . | |
| 0184781 | 6/1986 | European Pat. Off. . | |
| 0342463 | 11/1989 | European Pat. Off. | 36/117 |
| 0410091 | 1/1991 | European Pat. Off. . | |

*Primary Examiner*—David T. Fidei
*Assistant Examiner*—M. D. Patterson
*Attorney, Agent, or Firm*—Parkhurst, Wendel & Rossi

[57] ABSTRACT

Ski boot made of plastic material comprising:

a shell (1) intended to receive the foot of the skier and the lower part of the leg;

a deformable collar (3) which is articulated (4) in relation to the shell (1), intended to enclose the lower part of the leg and has a wide opening (15) in its rear part and, on the front, flaps (7, 8) which overlap and interact with closing (38, 37) and clamping members;

a rigid rear cover (20) which is articulated in relation to the shell (1) and intended to close the rear opening of the deformable collar (3);

an inner boot (40) intended to receive the foot and the lower part of the leg of the skier, characterized in that, in the use position, the rear cover (20) rests on by coming to abut on the collar (3) and is kept in abutment against the collar (3) by a closing member (30, 31).

9 Claims, 6 Drawing Sheets

SKI BOOT WITH SHELL AND COLLAR

BACKGROUND OF THE INVENTION

The invention relates to a ski boot of the type having a shell and a collar.

As is known, a ski boot comprises essentially:

a shell intended to receive the foot of the skier;

a collar which is articulated in relation to the shell and intended to enclose the lower part of the leg;

an inner boot intended to receive the foot and the lower part of the leg, to ensure the comfort of the skier; and members for closing the assembly.

In a first type conventional ski boot, the semi-rigid shell has a slot on the top of the instep, bringing two flaps into being, and the one-piece collar is deformable by virtue of the openings which are arranged on the front and also form flaps, and articulated about two rivets arranged on the sides of the shell. This arrangement permits tilting towards the front while a stop arranged on the rear of the shell prevents pivoting towards the rear. In this embodiment, the clamping on the foot and on the lower part of the leg is obtained by superposition of the flaps and by the mechanical action of closing members constituted by buckles or similar which bring together by sliding the flaps on the foot and on the lower part of the leg. In practice, this type of boot has at least one closing and clamping member, preferably two, acting on the flaps of the instep and at least one other closing and clamping member, preferably two also, acting on the flaps of the collar.

This arrangement ensures good retention of the foot and good steering of the ski. However, it requires major effort on the part of the skier for putting on and removing the boot. As a result, this type of boot is widely used by professional skiers and above all by competitors who seek performance above all rather than comfort.

Another type of boot has also been proposed, commonly called "rear entry". In this embodiment, the collar is made in two separate parts, a front cuff and a rear cuff respectively, which are both articulated in relation to the shell which is rigid and of predetermined volume. This solution facilitates putting the boot on. Adaptation to the different morphologies of the lower part of the leg is effected by virtue of the position of the rear cuff in relation to the front cuff. Although this solution advantageously solves the problem of putting the boot on and removing the boot, the retention of the foot on the other hand is not always very effectively ensured and the steering of the ski is clearly affected by this. It is for this reason that this type of boot is little used by professional skiers and competitors, and is used rather by the leisure skier.

In this practical embodiment of these rear-entry ski boots, the rear cuff follows the rear shape of the shell and comes to be articulated on the latter, the external sides of the top part of the rear cuff coming to be positioned and slide in the use position on the internal sides inside the front cuff. The adaptation of this boot to the morphology of the skier is then carried out by means of a buckle which positions the rear cuff resting on the leg of the skier. There is thus no fixed position of the rear cuff in relation to the front cuff.

In the document EP-A-O 342 463, a ski boot has been described, which is constituted by a shell and a collar articulated on the shell, having at the rear an opening and at the front flaps which interact with members for closing and clamping on the lower part of the leg. This rear opening is closed by a cover which can be adjusted in inclination towards the front by sliding under the edges of the opening, in particular by means of a lever, in order to adapt the rear of the boot to the morphology of the calf of the skier. This arrangement, which makes it possible to vary the perimeter of the clamping zone at the same time at the front via the closing members and at the rear via the lever, relates only to adapting the boot to the morphology of the calf of the skier. On the other hand, in these boots, the problem of putting the boot on and removing the boot is not satisfactorily resolved.

SUMMARY OF THE INVENTION

The invention eliminates these disadvantages. It relates to an improved ski boot of the type having a shell and a collar which is articulated in relation to the shell, which is easy to put on and to remove, after the manner of rear-entry boots, and which, like conventional boots, ensures good retention of the foot and is likewise accurate in the steering of the ski.

This improved ski boot, comprises:

a shell intended to receive the foot and the lower part of the leg of the skier;

a deformable collar which is articulated in relation to the shell, intended to enclose the lower part of the leg and has a wide opening in its rear part and, on the front, flaps which overlap and interact with closing and clamping members;

a rigid rear cover which is articulated in relation to the shell and intended to close the rear opening of the collar;

is characterized in that, in the use position, the rigid rear cover rests on by coming to abut on the collar and is kept in abutment on the collar by a closing member.

In other words, the ski boot according to the invention is an improvement over the conventional boots, according to which the deformable articulated collar has an added rigid cover which is articulated towards the rear on the shell, which thus facilitates the introduction or the withdrawal of the foot during the operation of putting the boot on and of removing the boot, but which, in the use position, comes to rest on and into abutment on this collar, so as to reconstitute the equivalent of a conventional deformable collar made in one single piece. Thus, the combination of a deformable collar having a wide opening at the rear and a rigid cover, both of which are articulated on the shell but rest on the collar, makes possible:

on the one hand, by tilting the flap towards the rear, to facilitate putting the boot on and removing the boot, and on the other hand, during skiing, to construct an assembly for clamping the lower part of the leg which acts like a conventional deformable collar, thus with good retention of the foot and accuracy in the steering of the ski, because the rigid rear cover interacts with the deformable collar so as to act like a homogeneous assembly.

In brief, the sporting advantages of conventional boots are combined with the advantages of comfort of rear-entry boots.

Advantageously, in practice:

the collar and the cover are articulated on the shell about one and the same pivot arranged in the region of the malleoli;

the collar and the cover are articulated on a movable piece which is itself articulated in relation to the shell;

the closing members are fixed to a tab which is fixed to the collar and surrounds the rear of the articulated cover;

the means of keeping the articulated rear cover resting in abutment on the collar are fixed to the cover and come to be fastened on the two lateral sides of the collar, in a permanent or instantaneous manner;

the collar has lugs provided towards the rear and on the top of the rear opening, which are intended during closing to ensure the guidance of the articulated rear cover until it comes into abutment on the collar;

the articulated rear cover has lugs provided towards the front, which are intended to ensure the guidance of the cover during closing;

the inner boot is made in two parts: a main part surrounding the foot and the front of the lower part of the leg, and a rear part which is fixed to the rear cover and opens with it; this rear part of the inner boot has lateral lugs directed towards the front, which are likewise intended for the guidance of the rear cover in relation to the collar during closing of the boot;

finally, the bottom part of the rear cover passes over the front collar and the top part of the rear cover has two lugs which pass inside the collar.

In a practical embodiment, the opposite zones of contact, that is to say of resting in abutment, of the rigid rear cover and of the deformable collar have one a tenon and the other a mortise provided in its thickness, so that the resting in abutment and the centring are brought about by penetration of the tenon into the mortise.

In an advantageous embodiment, the means of closing and of clamping the rear cover in abutment on the collar allow three separate positions of the rear cover, respectively:

a first, closed position, known as "use" position, in which the rigid rear cover is in firm abutment against the deformable collar according to the essential characteristic of the invention;

a second, semi-open position, known as "relaxation or walking" position, in which the rear cover is slightly open in relation to the collar;

finally, a third, open position making possible putting the boot on and removing the boot without difficulty, by total pivoting of the rigid cover towards the rear.

In known manner, the shell, the collar and the cover are made of plastic material in common use for this application.

The manner in which the invention can be made and the advantages which derive therefrom will emerge more clearly from the exemplary embodiments which follow supported by the attached figures.

DETAILED DESCRIPTION OF THE INVENTION

Figure 1:
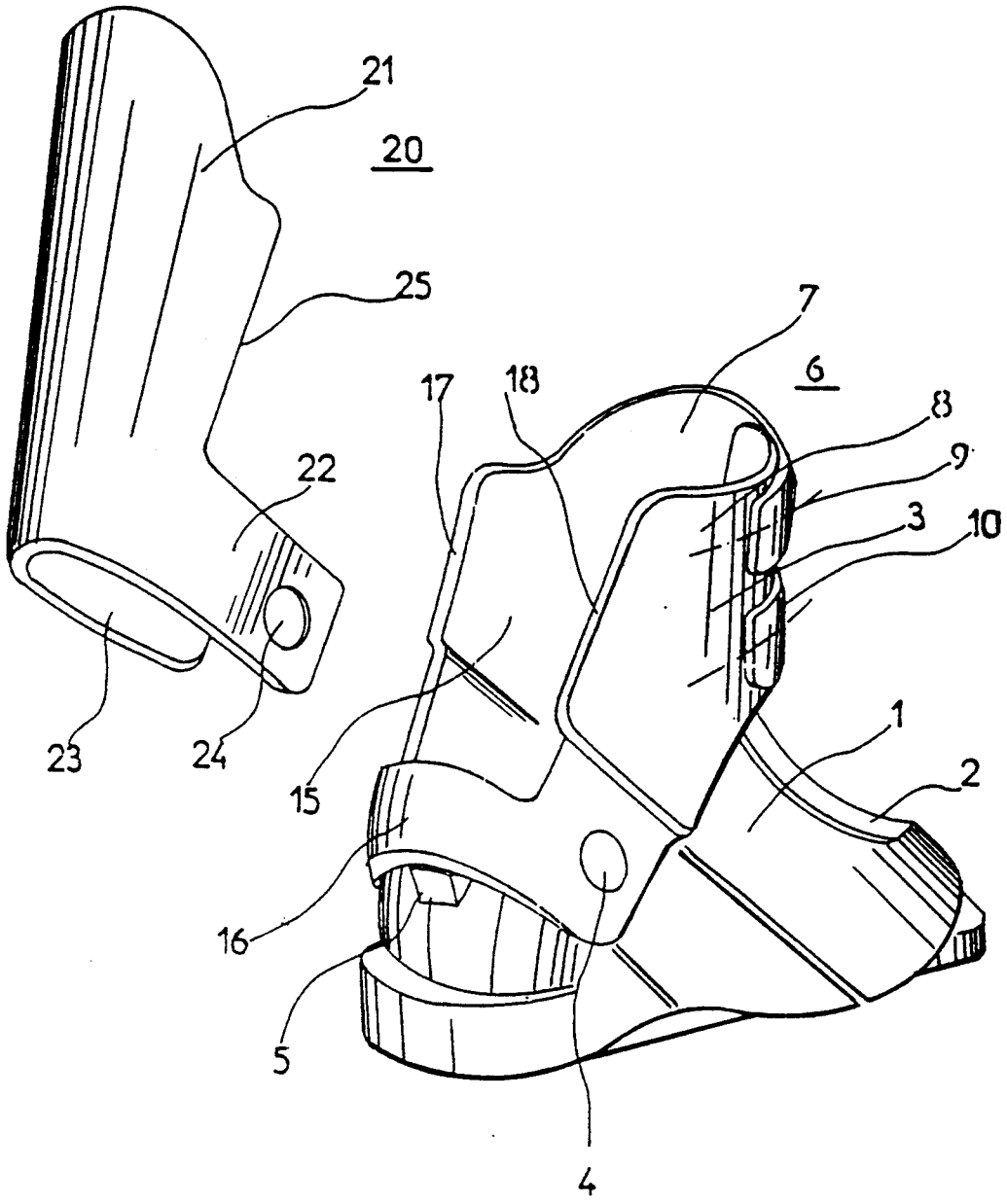
FIG. 1 is a basic rear three-quarter view in perspective of a boot according to the invention.

The boot of the present invention (see FIG. 1) is made up in known manner of a shell (1), on the top of which there is provided a slot defining two flaps (2) arranged above the instep. On this shell (1), a collar (3) is articulated towards the front about a pivot (4) arranged at the height of the malleoli; in practice, this articulation is formed by rivets. To limit the movement of the collar towards the rear, the shell (1) has, at the height of the calcaneum, an integrally moulded stop (5).

The front (6) of the collar comprises in known manner two lateral flaps (7, 8) which overlap to facilitate the introduction of the foot and to ensure clamping which is distributed over the lower part of the leg. The internal flap (7) has two tabs (9, 10) which cover the external flap (8) and which receive the known clamping and closing members (not shown), such as buckles, hooks, cables etc.

In known manner, this collar (3) is deformable by virtue of the sliding of the flaps (7, 8) over one another under the action of the closing members, for example buckle on tab (9, 10) and hook on external flap (8).

The deformable collar (3) has at the rear a wide opening (15) which is open from the top as far as the bottom of the Achilles tendon, so as to define a bridge (16) connecting the two lateral flaps (7 and 8) of the collar (3) which comes to rest at the rear on the stop (5). This wide opening (15) defines two parallel and rectilinear rigid resting faces (17, 18), of for example one to two millimeters in thickness.

According to an essential characteristic of the invention, the boot also comprises a rigid rear cover, designated by the general reference (20), which has the general shape of a tile (21) surrounding the rear of the lower part of the leg. This cover (20), which is likewise articulated on the shell at (4), is connected by two tabs (22, 23) which on each side have an orifice passing through (24), in which there comes to be accommodated an articulation rivet provided for this purpose on the collar (3) and the shell (1) in order to define the common articulation pivot (4).

The two front faces of the rigid rear cover (20) define two rigid parallel rectilinear edges (25) which are intended, according to a characteristic of the invention, to come to rest, in the closed position and the use position, against the two resting face (17, 18) provided for this purpose in the collar (3). In a practical embodiment, these resting faces (17, 18) and edges (25) have an equal thickness comprised between one and two millimeters.

Figure 5:
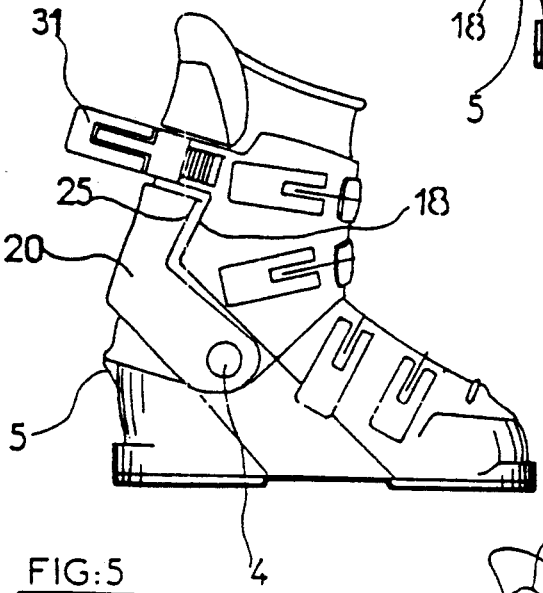
Figure 6:
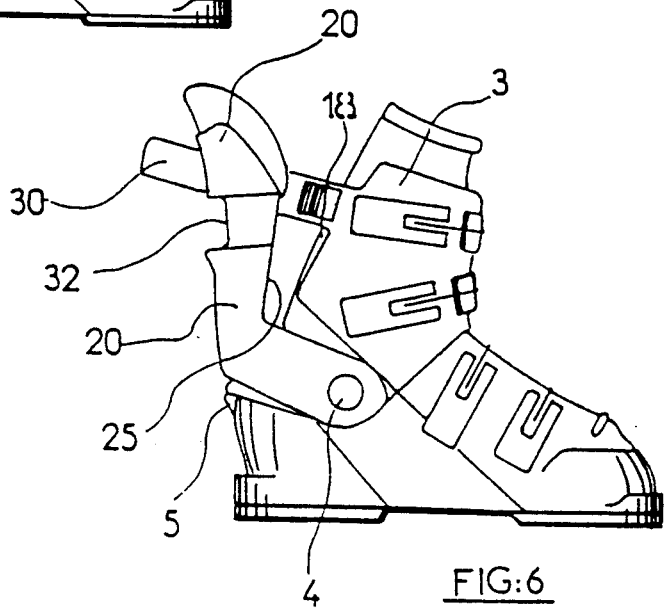

The top of the collar (3) includes a tab (30) directed towards the rear which receives a rack buckle (31) (see FIGS. 4 to 6), and the top of the rear cover (20) has an indentation (32) provided for this purpose to receive this tab (30) and the corresponding buckle (31) to ensure closing of the assembly.

The characteristic pieces shell (1), collar (3), rear cover (20) are made of moulded plastic material in common use for this application. The thicknesses and hardness of these elements are defined in known manner as a function of the use, the collar (3) being relatively flexible, while the rear cover (20) has to be rigid.

References (35, 36, 37, 38) designate normal closing and/or clamping members, such as buckles, racks, cables or similar.

Reference (40) symbolises the inner boot intended to receive the foot and the lower part of the leg of the skier.

Figure 7:
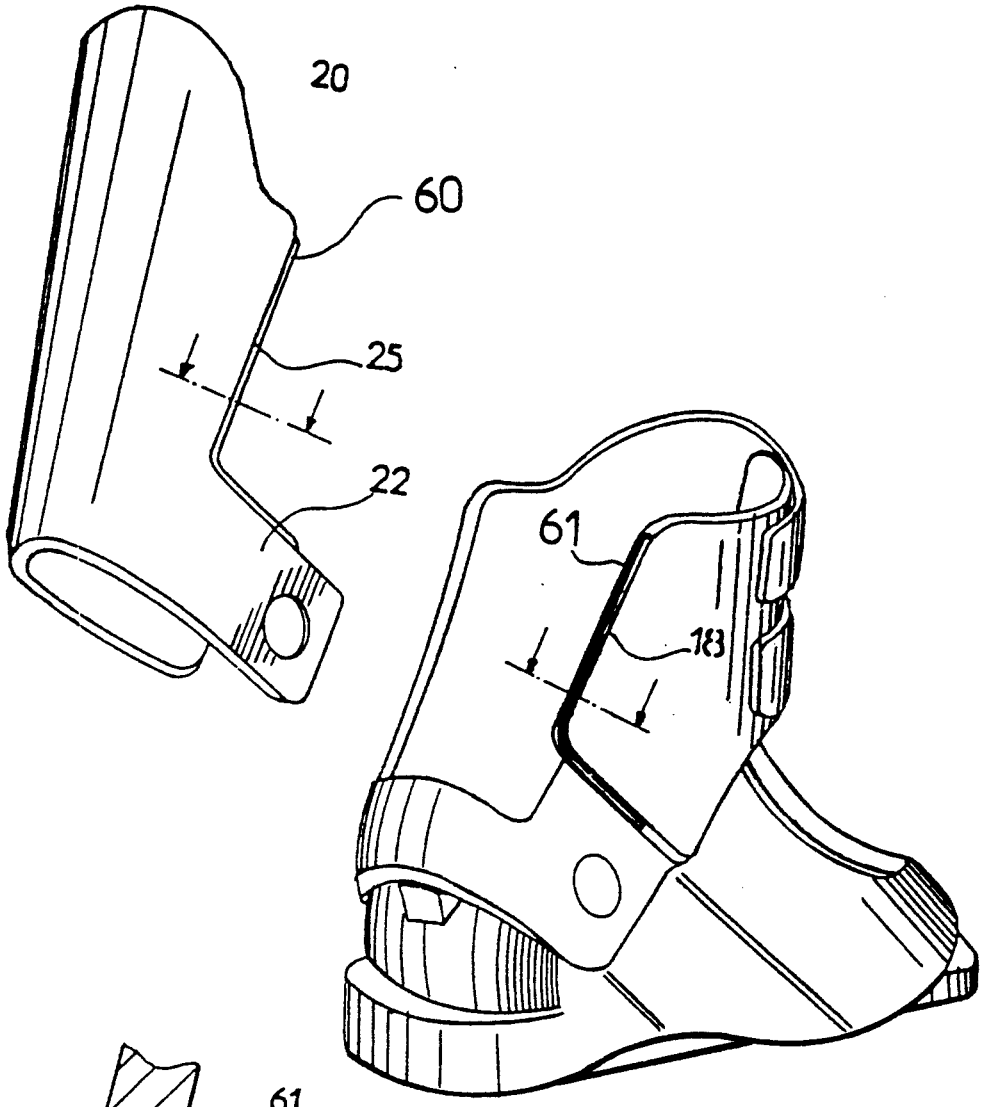
FIGS. 7 and 8 represent a detail of execution of the assembly of the articulated rear cover resting in abutment on the collar.
Figure 8:
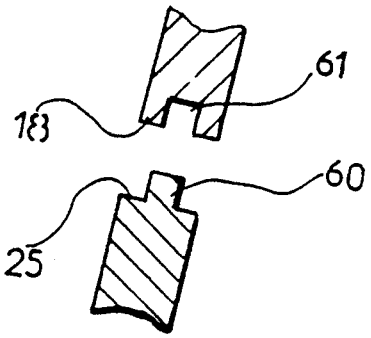

The characteristic resting according to the invention of the cover on the collar is effected advantageously (see FIGS. 7 and 8) by a tenon (60) system provided all along the edges (25) of the rear cover coming to be accommodated in and interact with a mortise (61) arranged for this purpose opposite in the rims (17, 18) of the collar.

The boot according to the invention functions in the following manner. In the closed position (see FIG. 4), also known as the "use" position, the rear cover articulated at (4) on the shell (1) comes to rest against the collar (3). More specifically, the rigid edges (25) come to rest and into firm abutment against the corresponding resting faces (17, 18) of the collar. By virtue of this, the collar (3) and rear cover (20) assembly reconstitutes the equivalent of a conventional one-piece collar. During skiing, this boot therefore acts exactly like a conventional boot and has all its advantages, in particular good retention of the foot and good steering of the ski.

When the skier wishes to relax or quite simply to walk (see FIG. 5), he loosens the buckle which serves only to ensure the closing of the rear cover (20) on the collar (3). This relieves the lower part of the leg, but keeps the foot perfectly in the shell (1). Moreover and above all, this position makes it possible for the skier to straighten his legs towards the vertical, which therefore facilitates walking and relaxes his muscles.

When the skier wishes to remove the boot (see FIG. 6), all he has to do then is to tilt the rear cover (20) towards the rear about the pivot (4), after having taken care to undo the buckle (31) completely. It is therefore easy to understand that this pivoting exposes towards the rear a wide opening, which facilitates the operation of removing the boot or putting the boot on, after the manner of the boots known as "rear entry".

The boot according to the invention thus has during use all the advantages of conventional boots, but on the other hand does not have their disadvantages during the operations of putting the boot on and of removing the boot, which until now it has been impossible to achieve. In other words, this boot can be successfully used by skiers of all levels, since it combines all the advantages of the conventional boots preferred by competition skiers or experienced skiers and of the rear-entry boots required by leisure skiers, while setting aside the disadvantages of each of them.

Figure 2:
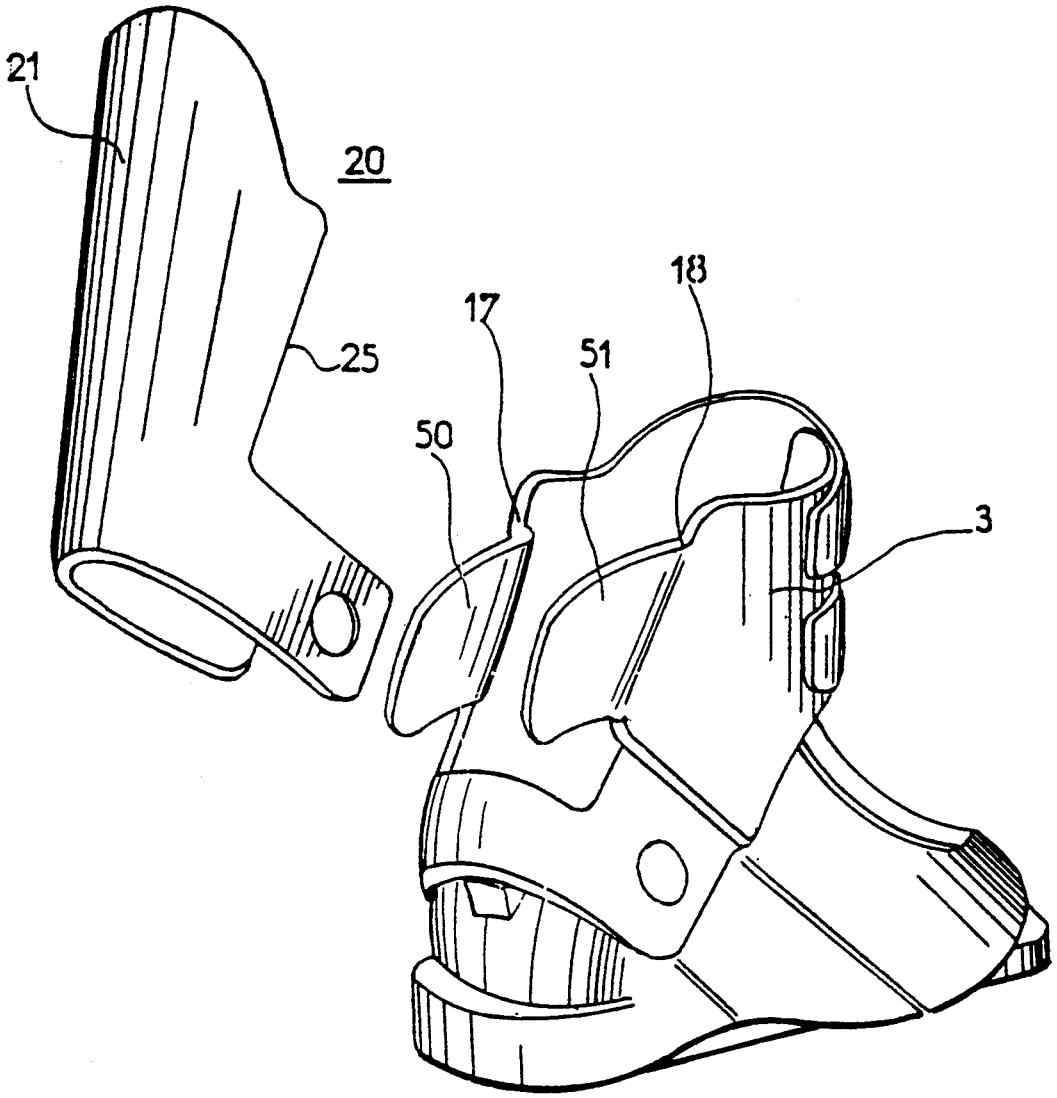
FIG. 2 shows an identical perspective view of an advantageous embodiment.

In another embodiment shown in FIG. 2, the rear sides of the collar (3) each have a lug, (50, 51) respectively, which is directed towards the rear and arranged along but at the side of the characteristic resting edges (17, 18), so as effectively to provide and preserve these resting faces. These flexible lugs (50, 51) serve, during closing, to guide the internal sides of the tile (21) in order properly to bring the rigid rims (25) into contact and into abutment against the edges (17, 18).

Figure 9:
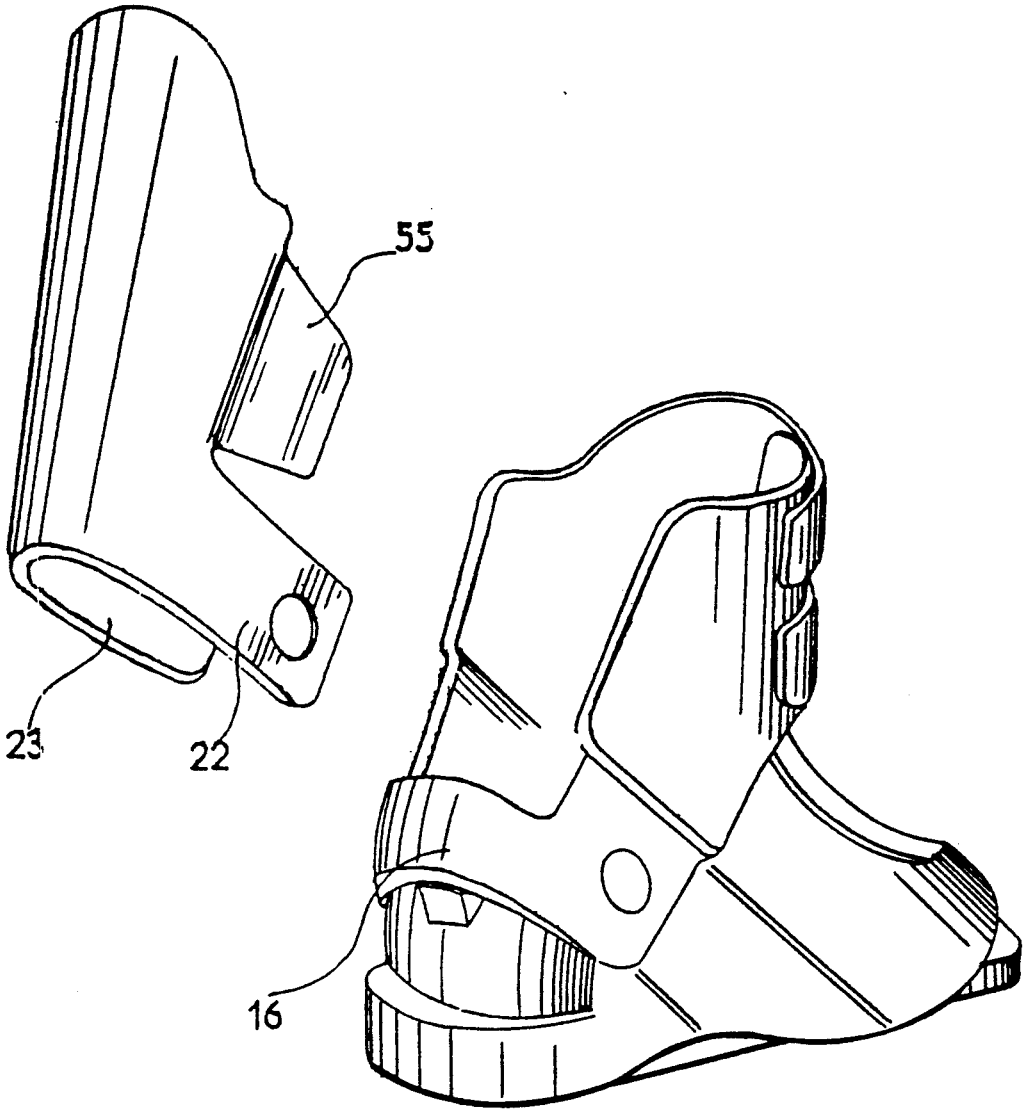
FIG. 9 shows in perspective another embodiment of the invention.

In an alternative (see FIG. 9), these lugs (55) can also be provided in the same manner (that is to say exposing the resting edges (25)) on the sides of the cover (20) but are in this case directed towards the front. In an alternative, the connection tabs (22, 23) of the tile (21) follow completely the rear of the bridge (16) while the lugs (55) come to be accommodated inside the collar in its top part. At the end of travel, that is to say in the use position, the edges (25) of the rigid cover (20) come into abutment against the resting faces (17, 18) of the deformable front collar (3).

Figure 3:
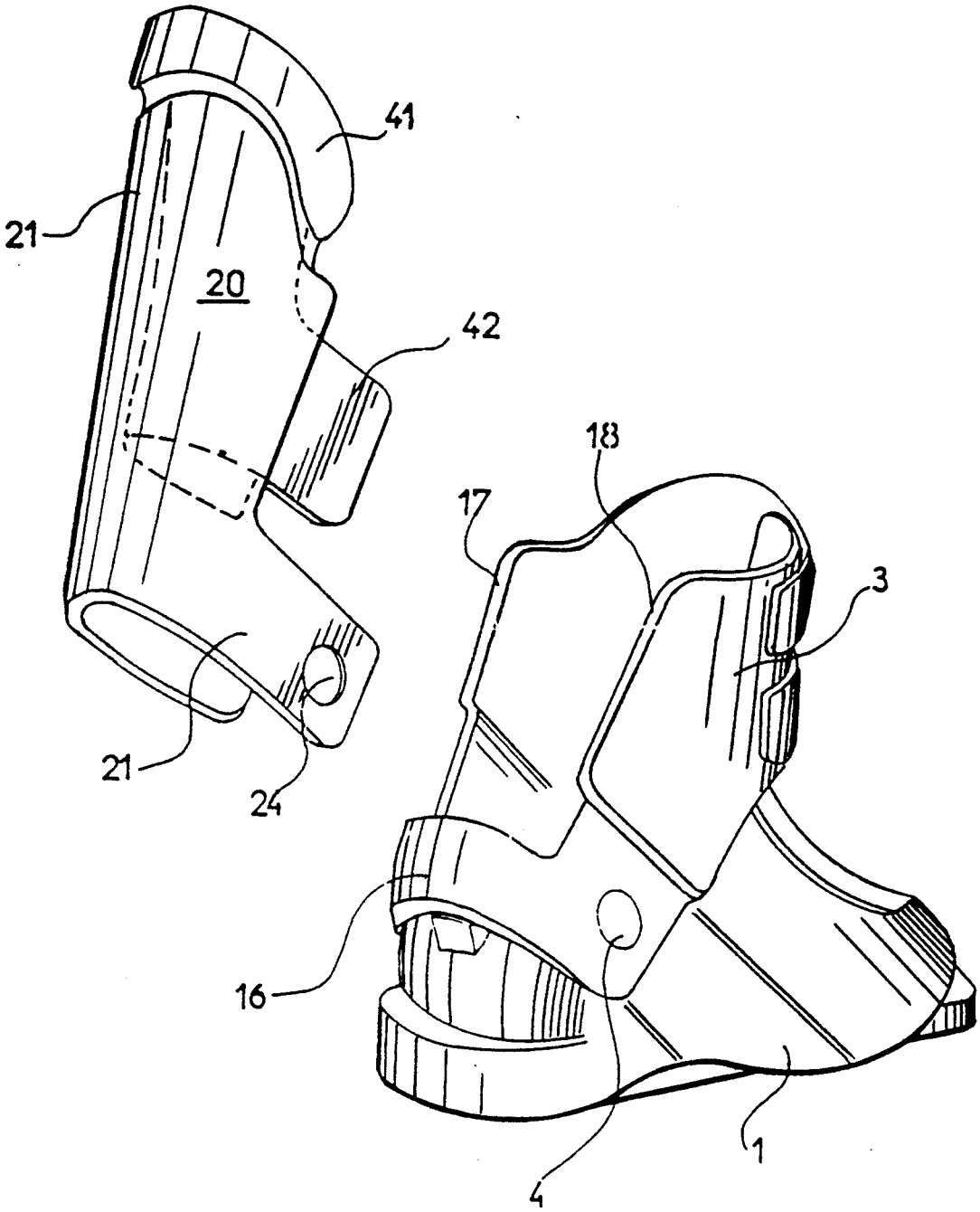
FIG. 3 likewise represents in perspective view of another advantageous embodiment.
Figure 4:
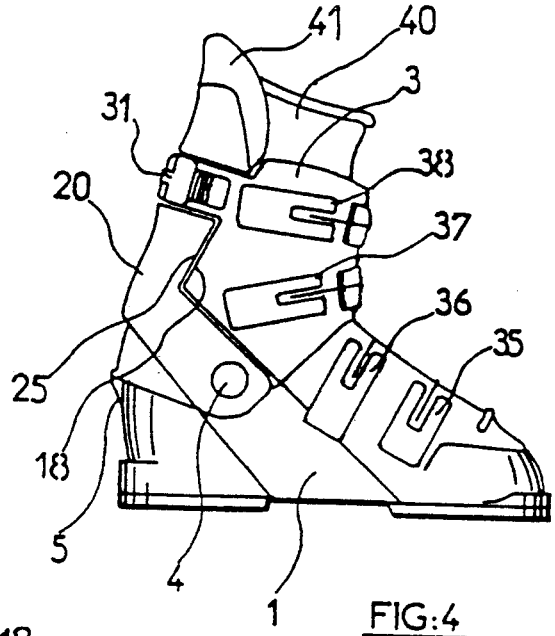
FIGS. 4, 5 and 6 show in side view a ski boot according to the invention, in closed position (FIG. 4), semi-open position (FIG. 5) and open position (FIG. 6).

In another embodiment shown in FIGS. 3 and 4, the inner boot (40) is made in two parts, namely an actual main part (40) surrounding the foot and the front of the lower part of the leg, and a rear part (41) which is fixed to the top of the tile (21) and opens with it. In this embodiment, this rear part (41) also has two lateral lugs (42) intended for the guidance of the rear cover (20) in relation to the collar (3) during closing.

The ski boot according to the invention has numerous advantages in relation to those known thus far. In effect, during skiing, it acts like a conventional ski boot, that is to say with perfect holding of the foot in the boot, thus optimum guidance and steering of the ski. Moreover, it does not have its disadvantages during putting the boot on and removing the boot since, on the contrary, it acts like a rear-entry boot.

I claim:

1. A ski boot, comprising:

an inner boot for receiving the foot and lower leg of a skier;

a shell for receiving said inner boot;

a deformable collar articulated in relation to said shell, said collar enclosing the lower leg of the skier and comprising, (a) on its front, (i) flaps which interact with closing and clamping members, and (ii) means for adjusting the fit of the ski boot around an upper portion of the lower leg, and (b) at its rear, a wide opening defined by two rigid abutting faces;

a rigid rear cover articulated in relation to said shell, said rear cover closing the rear wide opening of said collar and being defined, at its front, by two rigid abutting faces, wherein, in the use position of the ski boot, the abutting faces of said collar and the abutting faces of said rear cover abut against each other; and closing means for maintaining abutting contact between said collar and said rear cover through their respective abutting faces.

2. The ski boot of claim 1, wherein said collar and said rear cover are articulated on said shell about the same pivot point.

3. The ski boot of claim 1, wherein the abutting faces of said collar and said rear cover have a tenon and a mortise provided in their thicknesses, so as to insure abutment of the abutting faces by fitting into one another.

4. The ski boot of claim 1, wherein said closing means comprises a closing member which is fixed to an upper side of said collar, surrounds the rear of said rear cover, and is fastened on the opposite upper side of said collar.

5. The ski boot of claim 1, wherein at least one of the rear of said collar and the front of said rear cover has, adjacent the abutting faces thereof, two flexible lugs for insuring guidance of said cover in relation to said collar during closing of the ski boot.

6. The ski boot of claim 1, wherein said inner boot comprises a main part for surrounding the foot and front of the lower leg of the skier, and a rear part which is fixed on an upper portion of said cover and opens with said cover.

7. The ski boot of claim 6, wherein the rear part of said inner boot comprises two lateral lugs for insuring guidance of said rear cover in relation to said collar during closing of the ski boot.

8. The ski boot of claim 1, wherein said closing means comprises:

means for releasing abutting contact of the abutting faces of said collar and said rear cover to a semi-open position for facilitating walking or relaxation of the foot and lower leg of the skier; and means for releasing abutting contact of the abutting faces of said collar and said rear cover to a fully open position for facilitating removal of the ski boot from the foot of the skier.

9. The ski boot of the claim 1, further comprising stop means provided on the rear of said shell; and when the ski boot is in the use position, the stop means cooperates with the abutting faces of said collar and said rear cover to prevent the lower leg of the skier from extending beyond a predetermined angle with respect to the base of the ski boot.

* * * * *